US008408735B2

(12) United States Patent
Kretschmann

(10) Patent No.: US 8,408,735 B2
(45) Date of Patent: Apr. 2, 2013

(54) ACTUATING DEVICE FOR OPERATING LAMPS

(75) Inventor: Hanno Kretschmann, Hamburg (DE)

(73) Assignee: Dräger Medical GmbH, Lübeck (DE)

( * ) Notice: Subject to any disclaimer, the term of this patent is extended or adjusted under 35 U.S.C. 154(b) by 147 days.

(21) Appl. No.: 12/947,479

(22) Filed: Nov. 16, 2010

(65) Prior Publication Data

US 2011/0116260 A1 May 19, 2011

(30) Foreign Application Priority Data

Nov. 18, 2009 (DE) ..... 10 2009 053 795

(51) Int. Cl.
*F21V 9/16* (2006.01)
*F21V 23/04* (2006.01)

(52) U.S. Cl. ..... 362/231; 362/249.05; 362/800; 362/804

(58) Field of Classification Search ..... 362/804, 362/184, 230, 231, 249.05, 800
See application file for complete search history.

(56) References Cited

U.S. PATENT DOCUMENTS

| | | | | |
|---|---|---|---|---|
| 6,357,893 | B1 * | 3/2002 | Belliveau | 362/285 |
| 6,577,073 | B2 * | 6/2003 | Shimizu et al. | 315/246 |
| 7,014,336 | B1 * | 3/2006 | Ducharme et al. | 362/231 |
| 7,614,763 | B2 * | 11/2009 | Leibinger et al. | 362/235 |
| 7,621,653 | B2 * | 11/2009 | Hendrie | 362/231 |
| 8,016,470 | B2 * | 9/2011 | Li et al. | 362/573 |
| 2007/0153512 | A1 * | 7/2007 | Hendrie | 362/231 |
| 2008/0285820 | A1 | 11/2008 | Voelker | |
| 2010/0321930 | A1 * | 12/2010 | Watanabe et al. | 362/184 |
| 2011/0051408 | A1 * | 3/2011 | Wei et al. | 362/231 |

FOREIGN PATENT DOCUMENTS

| | | |
|---|---|---|
| DE | 102006030890 | 5/2007 |
| DE | 202007007054 U1 | 7/2007 |
| DE | 202007054 U1 | 3/2008 |
| DE | 102006040393 | 3/2008 |
| DE | 102007048115 | 4/2009 |
| EP | 1 568 936 | 8/2005 |

OTHER PUBLICATIONS

"Die LED Revolution"; Dr. Mach GmbH & Co, KG from Apr. 2009.

* cited by examiner

*Primary Examiner* — Alan Cariaso
(74) *Attorney, Agent, or Firm* — McGlew and Tuttle, P.C.

(57) ABSTRACT

An actuating device for operating lamps (1) includes an actuator provided for actuating a number of first light-emitting diodes (6) for generating white light, on the one hand, and a number of second light-emitting diodes (7) for generating single-color light, on the other hand. A control is provided such that only the first light-emitting diodes (6) are switched on in a first operating state of the operating lamp (1) and such that the first light-emitting diodes (6) and the second light-emitting diodes (7) are switched on in a second operating state. The second light-emitting diodes (7) are designed such that a preset color rendering index is greater in the second operating state than in the first operating state of the operating lamp (1).

14 Claims, 1 Drawing Sheet

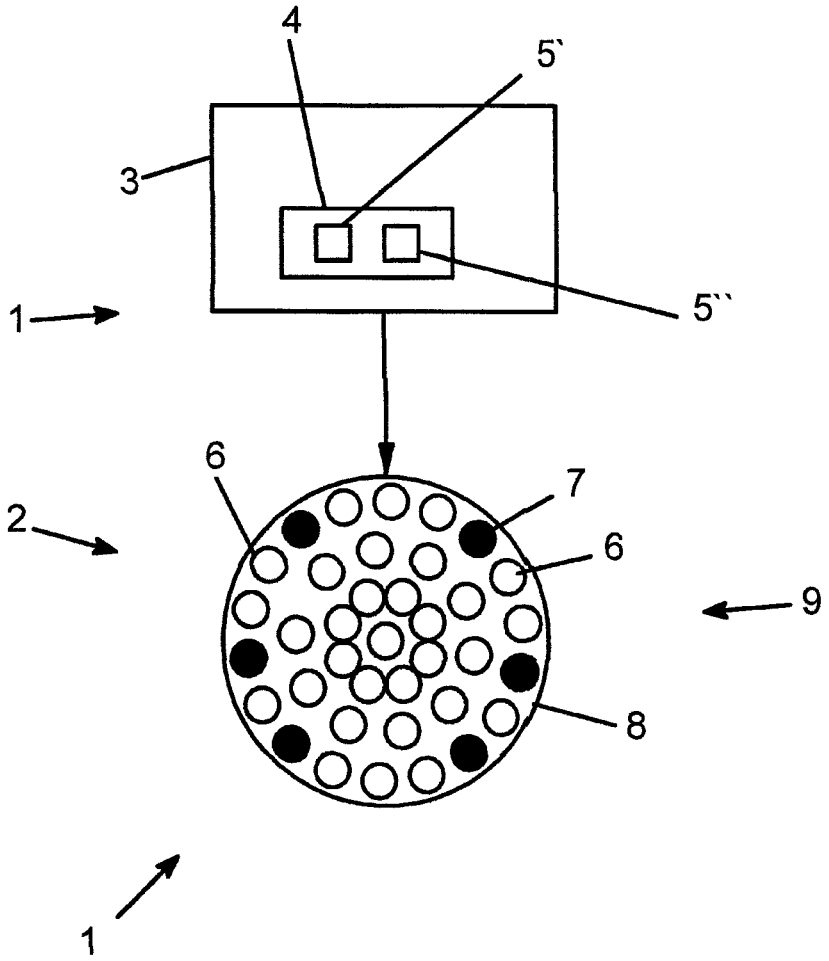
4
5`
3
5``
1
6
7
2
6
9
8
1

ACTUATING DEVICE FOR OPERATING LAMPS

CROSS REFERENCE TO RELATED APPLICATIONS

This application claims the benefit of priority under 35 U.S.C. §119 of German Patent Application DE 10 2009 053 795.3 filed Nov. 18, 2009, the entire contents of which are incorporated herein by reference.

FIELD OF THE INVENTION

The present invention pertains to an actuating device for operating lamps, wherein actuating means are provided for actuating a number of first light-emitting diodes for generating white light, on the one hand, and a number of second light-emitting diodes for generating single-color light, on the other hand.

The present invention pertains, furthermore, to an operating lamp.

BACKGROUND OF THE INVENTION

An actuating device for operating lamps, by means of which a number of first light-emitting diodes for generating white light, on the one hand, and a number of second light-emitting diodes for generating colored light, on the other hand, can be actuated, is known from EP 1 568 936 A1. The prior-art actuating device has actuating means, so that the second LEDs can be actuated in a continuously dimmable manner for setting a preset color temperature or color rendering. The mixed light generated in the process always has a "purely white" character.

SUMMARY OF THE INVENTION

The object of the present invention is to improve an actuating device for operating lamps for an operating lamp such that an application-related setting of a certain and set color rendering is guaranteed in a simple manner.

According to the present invention an actuating device for operating lamps is provided with light emitting diodes forming an actuatable first set light-emitting diodes and an actuatable second set of light-emitting diodes. An actuating means is provided such that exclusively the first light-emitting diodes are switched on in a first operating state of the operating lamp and that the first light-emitting diodes and the second light-emitting diodes are switched on in a second operating state of the operating lamp. The second light-emitting diodes are designed such that a preset color rendering index is greater in the second operating state than in the first operating state of the operating lamp.

According to another aspect of the invention, an operating lamp is provided comprising light emitting diodes forming an actuatable first set light-emitting diodes for generating white light and an actuatable second set of light-emitting diodes for generating single-color light. A light module is provided accommodating the first set of light-emitting diodes and the second set of light-emitting diodes. An actuator means is provided for actuating the first set of light-emitting diodes, and also for actuating the second set of light-emitting diodes such that only the first light-emitting diodes are switched on in a first operating state of the operating lamp and that the first light-emitting diodes and the second light-emitting diodes are switched on in a second operating state wherein the second light-emitting diodes have a preset, certain color rendering index that is greater in the second operating state than in the first operating state of the operating lamp.

Second light-emitting diodes are designed according to the present invention such that by switching them on in addition or superimposing them to first light-emitting diodes, which emit white light, a significantly increased specific color rendering index Rn is generated. The color rendering index R9 is especially preferred. A color rendering can thus advantageously take place at a site of operation especially with many shades of red, which may have a favorable effect on the result of surgery. By switching on the second light-emitting diodes temporarily in addition to the first light-emitting diodes, it is possible to change over rapidly between illumination of the site of operation with "purely white" light and with preferably added or admixed "red" light in a user-dependent manner. Thus, the present invention makes it possible to temporarily optimize an Rn color rendering index, especially the R9 color rendering index. The general color rendering index Ra can change during this operation. The resulting color temperature of the lamp light can also change, for example for example, in case of emission with the addition of "red" light, down to less than 4,000 K, or, for example with the addition of "blue" light, above 5,000 K. However, the resulting light remains "white," i.e., within the known "color hexagon.

For a solution of this task, the operation lamp according to the invention provides a light module accommodating the first light-emitting diodes and the second light-emitting diodes wherein the second light-emitting diodes are distributed uniformly in the light module of the operating lamp. The second light-emitting diodes may be arranged distributed in the area of a circumferential edge of a light exit area. In particular, the second light-emitting diodes are arranged uniformly distributed in the area of the circumferential edge of the light exit area. The second light-emitting diodes may be arranged adjacent to the outer, first light-emitting diodes in the circumferential direction of the light exit area, wherein two of the second light-emitting diodes are combined as twin light-emitting diodes in a common housing.

The first and second light-emitting diodes may each combined on one or more LED chips.

The actuator means may comprise a control unit with a control selector element to set the first operating state and a control selector element to set the second operating state.

The special advantage of the operating lamp according to the present invention is that a homogeneous mixed light is generated due to the distributed arrangement of the single-color second LEDs in the area of the operating lamp or the light exit area thereof, so that a light beam with a relatively high color rendering index Rn, especially R9, can be emitted onto the site of operation in a second operating state by means of the first light-emitting diodes and the second light-emitting diodes, wherein the color shade is relatively low and the composition of the mixed light depends only slightly on shade generation.

According to a variant of the present invention, the operating lamp has a control unit, which has an additional control element (selector element) for setting the second operating state. As a result, the second LEDs can advantageously be switched on by the staff assisting the surgeon in a simple manner, so that either "white" light corresponding to the first operating state or the resulting light with admixed color light corresponding to the second operating state is emitted in an application-dependent manner.

An exemplary embodiment will be explained in more detail on the basis of the FIGURE. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a block diagram of an operating lamp according to the present invention with an actuating device.

DESCRIPTION OF THE PREFERRED EMBODIMENTS

Referring to the drawings in particular, an operating lamp 1 has a light module 2, which can be actuated in at least two operating states by means of an actuating device 3. The actuating device 3 has a control unit 4 with a plurality of control elements 5 (control buttons—selector elements), so that the different operating states of the operating lamp 1 can be set by a surgeon by actuating the control elements 5. By actuating a first control element 5', actuating means of the actuating device 3 cause a number of first light-emitting diodes 6 (LED chips) of the light module 3 to be switched on, so that "white" light is generated in a first operating state. The first light-emitting diodes 6 are designed as white light-emitting diodes, which emit white light of a color temperature in the range of, for example, 4,400 K.

The first and second light-emitting diodes 6, 7 may also be arranged, for example, combined in pairs on LED chips or designed in one assembly unit.

By actuating a second operating element 5" by means of corresponding actuating means of the actuating device 3, the second LEDs 7 can be switched on in addition to the first light-emitting diodes 6, so that a specific single-color light is mixed with or superimposed to the white light in a second operating state. The second light-emitting diodes 7 may be designed, for example, as red light-emitting diodes, which have a radiation spectrum whose maximum is at 640 nm. When the second LEDs 7 are additionally switched on, the radiation capacity of the light module 2 can be increased by about 10% to 20%, so that the total radiation capacity emitted can possibly be reduced or is reduced as needed. The general color rendering index $R_a$ is increased. In particular, the color rendering index R9 is greatly increased, but R8 and R15 are markedly increased as well. R1 and R13 are likewise higher, see Table 1.

TABLE 1

| | first operating state | second operating state |
|---|---|---|
| Color temperature | 4401 | 3739 |
| Ra | 87.6 | 97.4 |
| Rg | 82.0 | 95.9 |
| R1 | 86.6 | 97.7 |
| R2 | 92.2 | 98.4 |
| R3 | 96.2 | 95.4 |
| R4 | 86.5 | 97.6 |
| R5 | 85.8 | 98.2 |
| R6 | 88.6 | 94.9 |
| R7 | 90.4 | 97.5 |
| R8 | 74.3 | 99.3 |
| R9 | 32.0 | 98.1 |
| R10 | 81.0 | 97.2 |
| R11 | 86.5 | 94.6 |
| R12 | 61.8 | 77.5 |
| R13 | 88.3 | 98.0 |

TABLE 1-continued

| | first operating state | second operating state |
|---|---|---|
| R14 | 98.1 | 96.4 |
| R15 | 81.1 | 97.3 |

As is apparent from Table 1, especially the dark red color rendering index R9 is increased significantly, so that improved color discriminability is achieved in the red color range. The dark red color rendering index R9 increases to a value of 98.1 and is consequently substantially greater than the color rendering index R9 in the first operating state.

The second LEDs 7 are arranged distributed in the area of a circumferential edge 8 of the light exit area 9 of light module 2 in this exemplary embodiment. The second light-emitting diodes 7 are arranged as twin LEDs in a common housing, with six twin LEDs 7 extending in a uniformly distributed pattern on the circumferential edge of the light exit area 9 of light module 2. The twin LEDs 7 are thus arranged in an outer concentric ring of the light exit area 9 in this special embodiment, and they are adjacent to the first light-emitting diodes 6. Further concentric rings extend with a smaller radius within the light exit area 9 and have exclusively the first LEDs 6.

According to a first alternative embodiment of the present invention, the second LEDs may also be designed as blue LEDs, which emit light in a spectral range with a maximum at 450 nm. The color rendering index R9 is surprisingly also substantially increased hereby. However, the general color rendering index $R_a$ as well as the color rendering indices R1, R8, R13 and R15 are measurably increased as well. Contrary to the use of red LEDs, the color temperature is markedly increased in case of the use of blue LEDs, see Table 2.

TABLE 2

| | first operating state | second operating state |
|---|---|---|
| Color temperature | 4401 | 5685 |
| Ra | 87.6 | 92.5 |
| Rg | 82.0 | 90.5 |
| R1 | 86.6 | 94.1 |
| R2 | 92.2 | 95.2 |
| R3 | 96.2 | 94.5 |
| R4 | 86.5 | 94.6 |
| R5 | 85.8 | 93.4 |
| R6 | 88.6 | 88.5 |
| R7 | 90.4 | 91.6 |
| R8 | 74.3 | 88.2 |
| R9 | 32.0 | 71.5 |
| R10 | 81.0 | 91.4 |
| R11 | 86.5 | 93.9 |
| R12 | 61.8 | 70.0 |
| R13 | 88.3 | 94.8 |
| R14 | 98.1 | 96.8 |
| R15 | 81.1 | 98.5 |

While specific embodiments of the invention have been described in detail to illustrate the application of the principles of the invention, it will be understood that the invention may be embodied otherwise without departing from such principles.

APPENDIX

LIST OF REFERENCE NUMBERS

| No. | Name |
|---|---|
| 1 | Operating lamp |
| 2 | Light module |
| 3 | Actuating device |
| 4 | Control unit |
| 5, 5', 5" | Control elements |
| 6 | First LEDs |
| 7 | Second LEDs |
| 8 | Circumferential edge |
| 9 | Light exit area of 1, 2 |

What is claimed is:

1. An actuating device for operating lamps, the device comprising:

light emitting diodes including actuatable first light-emitting diodes for generating a first white light and actuatable second light-emitting diodes for generating a blue light;

an actuator for actuating the first light-emitting diodes to generate said first white light, and also for actuating the second light-emitting diodes to generate said blue light such that only the first light-emitting diodes are switched on in a first operating state of the operating lamp and that the first light-emitting diodes and the second light-emitting diodes are switched on in a second operating state to generate a second white light, wherein the second light-emitting diodes are designed such that a general color rendering index $R_a$ and a color rendering index $R_9$ is greater than 70, and a color temperature in the second operating state is greater than a color temperature in the first operating state of the operating lamp.

2. An actuating device in accordance with claim 1, wherein the first light-emitting diodes and the second light-emitting diodes are chosen to have said general color rendering index Ra greater than 90.

3. An actuating device in accordance with claim 1, wherein:

said second light-emitting diodes radiate light in a spectral range with a maximum at 450 nm.

4. An operating lamp comprising:

light emitting diodes comprising an actuatable first set of light-emitting diodes for generating a first white light and an actuatable second set of light-emitting diodes for generating a blue light;

a light module accommodating the first set of light-emitting diodes and the second set of light-emitting diodes, and having a light exit area, said second light-emitting diodes being arranged distributed in an area of a circumferential edge of said light exit area;

an actuator means for actuating the first set of light-emitting diodes, and also for actuating the second set of light-emitting diodes such that only the first light-emitting diodes are switched on in a first operating state of the operating lamp and that the first light-emitting diodes and the second light-emitting diodes are switched on in a second operating state to generate a second white light, wherein the second light-emitting diodes are such that a general color rendering index $R_a$ and a color rendering index $R_9$ is greater than 70, and a color temperature in the second operating state is greater than a color temperature in the first operating state of the operating lamp.

5. An operating lamp in accordance with claim 4, wherein the second light-emitting diodes are arranged uniformly distributed in the area of the circumferential edge of the light exit area.

6. An operating lamp in accordance with claim 4, wherein the second light-emitting diodes are arranged adjacent to the outer, first light-emitting diodes in the circumferential direction of the light exit area, wherein two of the second light-emitting diodes are combined as twin light-emitting diodes in a common housing.

7. An operating lamp in accordance with claim 4, wherein the first and second light-emitting diodes are commonly combined on one or more LED chips.

8. An operating lamp in accordance with claim 4, wherein the actuator means comprises a control unit with a control selector element to set the first operating state and a control selector element to set the second operating state.

9. An operating lamp in accordance with claim 4, wherein the first light-emitting diodes and the second light-emitting diodes are chosen for the lamp to provide said general color rendering index $R_a$ in the second operating state greater than 90.

10. An operating lamp in accordance with claim 4, wherein:

said second light-emitting diodes radiate light in a spectral range with a maximum at 450 nm.

11. An operating lamp comprising:

a plurality of first light-emitting diodes for generating a first white light with a first general color rendering index;

a plurality of second light-emitting diodes generating a blue light, a combination of said first white light and said blue light creating a second white light, said first and second light emitting diodes being arranged to have said second white light have a second general color rendering index $R_a$ and a color rendering index $R_9$ that is greater than 70, said second white light having a color temperature greater than a color temperature of said first white light;

a light module accommodating said first light-emitting diodes and said second light-emitting diodes to emit the respective light in a similar direction;

an actuator for actuating said first light-emitting diodes, and also for actuating said second light-emitting diodes, said actuator selectively switching between a first operating state of the operating lamp with said first light-emitting diodes on and said second light-emitting diodes off, and a second operating state with said first light-emitting diodes and said second light-emitting diodes on.

12. An operating lamp in accordance with claim 11, wherein:

said first and second white lights have a color temperature between 3739 and 5685.

13. An operating lamp in accordance with claim 11, wherein:

said second light-emitting diodes radiate light in a spectral range with a maximum at 450 nm.

14. An operating lamp in accordance with claim 11, wherein:

said second general color rendering index $R_a$ is greater than 90.

* * * * *